US010272286B2

(12) United States Patent
Liao Lai

(10) Patent No.: US 10,272,286 B2
(45) Date of Patent: Apr. 30, 2019

(54) CLIMBING EXERCISER

(71) Applicant: Shu-Chiung Liao Lai, Taichung (TW)

(72) Inventor: Shu-Chiung Liao Lai, Taichung (TW)

( * ) Notice: Subject to any disclaimer, the term of this patent is extended or adjusted under 35 U.S.C. 154(b) by 147 days.

(21) Appl. No.: 15/645,470

(22) Filed: Jul. 10, 2017

(65) Prior Publication Data

US 2019/0009129 A1 Jan. 10, 2019

(51) Int. Cl.

| | |
|---|---|
| ***A63B 21/00*** | (2006.01) |
| ***A63B 22/00*** | (2006.01) |
| ***A63B 22/04*** | (2006.01) |
| ***A63B 23/035*** | (2006.01) |

(52) U.S. Cl.

CPC ..... *A63B 22/04* (2013.01); *A63B 21/00192* (2013.01); *A63B 21/154* (2013.01); *A63B 21/4034* (2015.10); *A63B 21/4035* (2015.10); *A63B 22/0002* (2013.01); *A63B 23/03591* (2013.01); *A63B 2209/08* (2013.01); *A63B 2225/09* (2013.01)

(58) Field of Classification Search

CPC ..... A63B 22/04; A63B 23/03591; A63B 21/4035; A63B 21/154; A63B 22/0002; A63B 21/00192; A63B 21/4034; A63B 2225/09; A63B 2209/08

See application file for complete search history.

(56) References Cited

U.S. PATENT DOCUMENTS 4,708,338 A * 11/1987 Potts ..... A63B 21/023 482/52
5,242,341 A * 9/1993 Yeh ..... A63B 22/04 482/52
6,063,009 A * 5/2000 Stearns ..... A63B 21/15 482/51
6,302,825 B1 * 10/2001 Stearns ..... A63B 21/15 482/51
6,340,340 B1 * 1/2002 Stearns ..... A63B 21/15 482/52
6,409,632 B1 * 6/2002 Eschenbach ..... A63B 22/001 482/52
6,626,802 B1 * 9/2003 Rodgers, Jr. ..... A63B 21/00181 482/110
6,689,021 B2 * 2/2004 Stevens ..... A63B 23/03575 482/51

(Continued)

*Primary Examiner* — Garrett K Atkinson
(74) *Attorney, Agent, or Firm* — C. G. Mersereau; DeWitt LLP

(57) ABSTRACT

A climbing exerciser includes a base having two parallel rail posts to which two sliding units are respectively connected. Each sliding unit includes a sliding rod, a handle and a pedal. The sliding rod is movably located in the correspondent rail post. A transmission unit includes two down chain wheels and two up chain wheels respectively and rotatably connected to the support. Two front chains are engaged with the down chain wheels and connected with the connection members. Two side chains are engaged with the two up chain wheels and connected with the connection members. A cable is engaged with two respective two stationary pulleys and connected to the two side chains. A magnetic-resistance unit is connected to the support and driven by the two up chain wheels. The two sliding posts alternatively movable along the rail post to simulate rock climbing actions.

8 Claims, 9 Drawing Sheets

(56) References Cited

U.S. PATENT DOCUMENTS 6,846,273 B1 * 1/2005 Stearns ..... A63B 22/0007 482/52
7,172,531 B2 * 2/2007 Rodgers, Jr. ..... A63B 22/001 482/52
7,874,963 B2 * 1/2011 Grind ..... A63B 22/001 482/51
8,272,995 B2 * 9/2012 Stearns ..... A63B 22/001 482/52
8,317,663 B2 * 11/2012 Stewart ..... A63B 22/001 482/52
9,878,194 B2 * 1/2018 Young ..... A63B 22/205
2001/0056010 A1 * 12/2001 Stearns ..... A63B 22/001 482/52
2002/0082146 A1 * 6/2002 Stearns ..... A63B 22/203 482/54
2002/0094914 A1 * 7/2002 Maresh ..... A63B 21/068 482/51
2004/0077465 A1 * 4/2004 Schmidt ..... A63B 21/0058 482/57
2005/0043148 A1 * 2/2005 Maresh ..... A63B 21/068 482/70
2005/0049120 A1 * 3/2005 Maresh ..... A63B 22/0007 482/57
2005/0101446 A1 * 5/2005 Stearns ..... A63B 21/15 482/52
2005/0187073 A1 * 8/2005 Krull et al. ..... A63B 22/001 482/72
2007/0087904 A1 * 4/2007 Yang ..... A63B 21/00192 482/52
2007/0161464 A1 * 7/2007 Chiles ..... A63B 22/001 482/52
2007/0219061 A1 * 9/2007 Rodgers, Jr. ..... A63B 21/151 482/52
2007/0219063 A1 * 9/2007 Anderson ..... A63B 21/154 482/52
2010/0137110 A1 * 6/2010 Rodgers, Jr. ..... A63B 21/151 482/52
2010/0144496 A1 * 6/2010 Schmidt ..... A63B 21/012 482/70
2010/0173754 A1 * 7/2010 Rodgers, Jr. ..... A63B 21/154 482/52
2010/0248899 A1 * 9/2010 Bedell ..... A63B 22/001 482/4
2011/0136628 A1 * 6/2011 Stearns ..... A63B 22/001 482/52
2011/0281692 A1 * 11/2011 Maresh ..... A63B 21/00072 482/54
2013/0337981 A1 * 12/2013 Habing ..... A63B 21/22 482/110
2017/0157445 A1 * 6/2017 Young ..... A63B 22/205

* cited by examiner

CLIMBING EXERCISER

BACKGROUND OF THE INVENTION

1. Fields of the Invention

The present invention relates to a climbing exerciser, and more particularly, to a climbing exerciser that exercises both hands and legs to simulate mounting climbing.

2. Descriptions of Related Art

There are many exercisers available today, and most of the exercisers are designed to simulate a specific type of exercise such as biking, stair climbing, or rowing. Each of the exercisers is able to train muscles of the users, however, there is no exerciser that is properly designed to train coordination of hands and legs. For rock climbers, how to coordinate hands and legs is an important issue, and a climbing exerciser that is able to train muscles of both hands and legs, and the coordination of hands and legs is a goal for the applicant.

The present invention intends to provide a climbing exerciser that simulates the actions of rock climbing.

SUMMARY OF THE INVENTION

The present invention relates to a climbing exerciser and comprises a base having two parallel rail posts which are connected to the base at an angle. A support is connected to the rear side of the rail posts. Two sliding units are respectively connected to the two rail posts, and each sliding unit comprises a sliding rod, a handle and a pedal. The sliding rod is movably located in the rail post corresponding thereto, and a connection member extends from the rear side of each sliding rod. The handle is connected to the upper portion of the sliding rod corresponding thereto. The pedal is connected to the lower portion of the sliding rod corresponding thereto.

A transmission unit comprises two down chain wheels, two up chain wheels, two stationary pulleys, a front chain, two side chains and a cable. The down chain wheels are respectively and rotatably connected to the lower end of the rear side of the two rail posts. The two up chain wheels are respectively and rotatably connected to the upper end of two sides of the support. The two stationary pulleys are respectively and rotatably connected to the lower end of the rear side of the support. The two front chains are engaged with two respective lower portions of the down chain wheels and connected with the two respective connection members of the two sliding rods. The two side chains are engaged with two respective upper portions of the two up chain wheels and connected with the two respective connection members of the two sliding rods. The cable is engaged with two respective lower portions of the two stationary pulleys and connected to the two side chains. A magnetic-resistance unit is connected to the support and driven by a wheel unit which is co-axially connected with the two up chain wheels. The resistance of the magnetic-resistance unit is controlled by a control button located at the front side of the base.

The primary object of the present invention is to provide a climbing exerciser which comprises two sliding rods movably connected to the two rail posts, and each sliding rod is connected with a handle and a pedal. The two sliding rods are respectively connected with two front chains which are engaged with two respective lower portions of the two down chain wheels. Two side chains are connected to the two sliding rods and engaged with two respective upper portions of the two up chain wheels. A cable is engaged with the two respectively lower portions of the stationary pulleys and two ends of the cable are connected between the two side chains. When one of the sliding rods moves upward, the other one of the two sliding rods moves downward, the movements of the two sliding rods simulate actions of rock climbing to the users.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
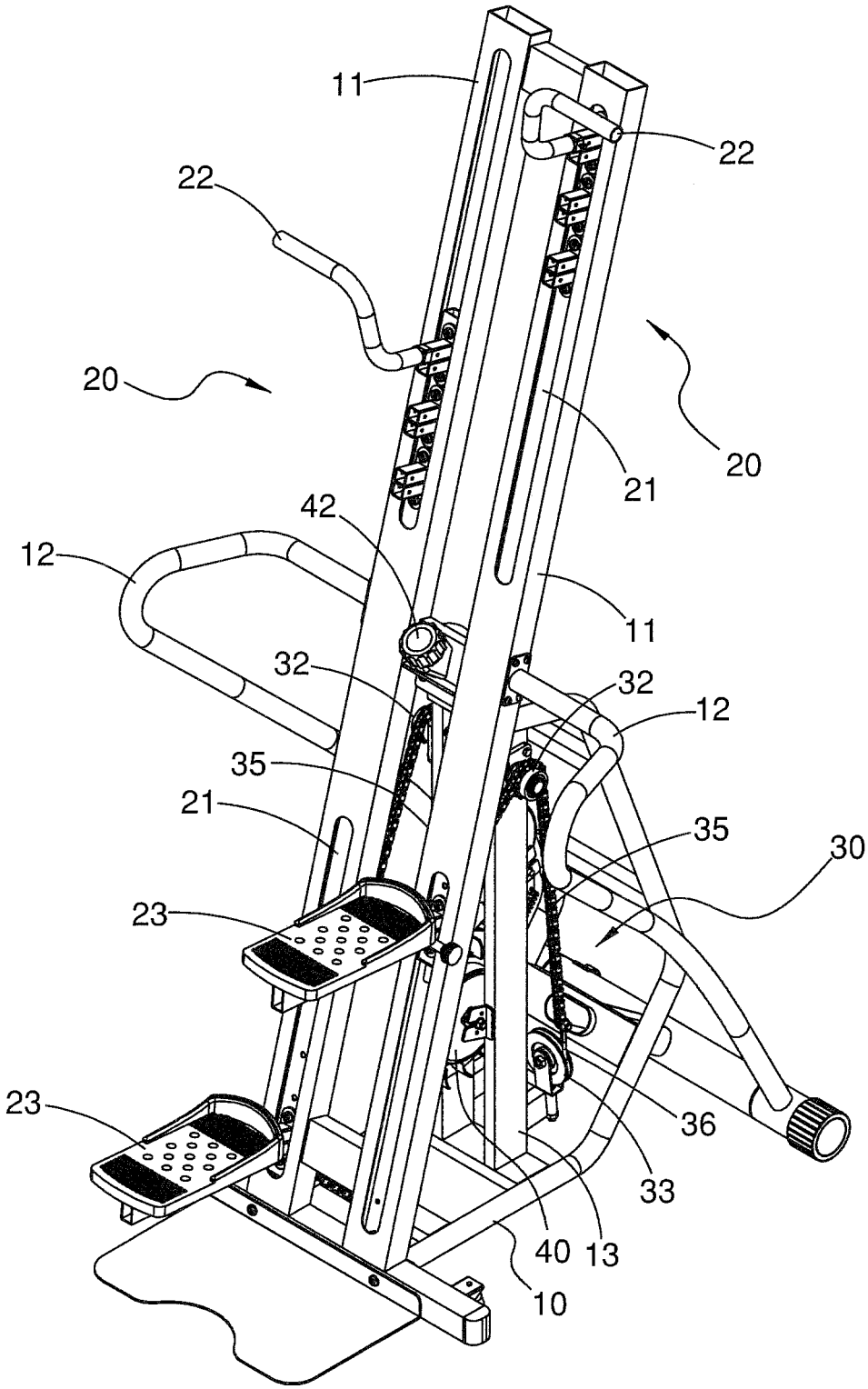
FIG. 1 is a front perspective view to show the climbing exerciser of the present invention.
Figure 2:
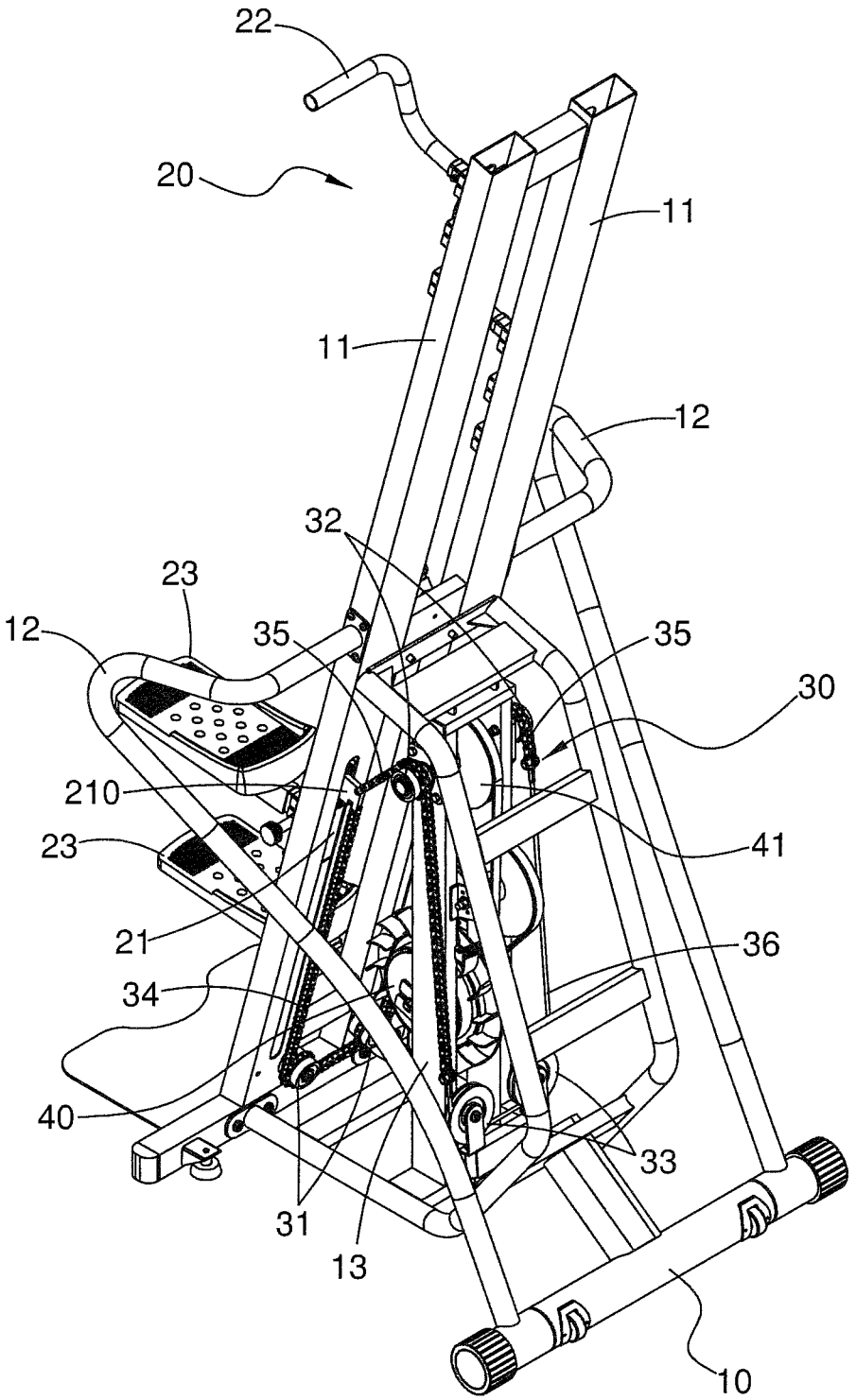
FIG. 2 is a rear perspective view to show the climbing exerciser of the present invention.
Figure 3:
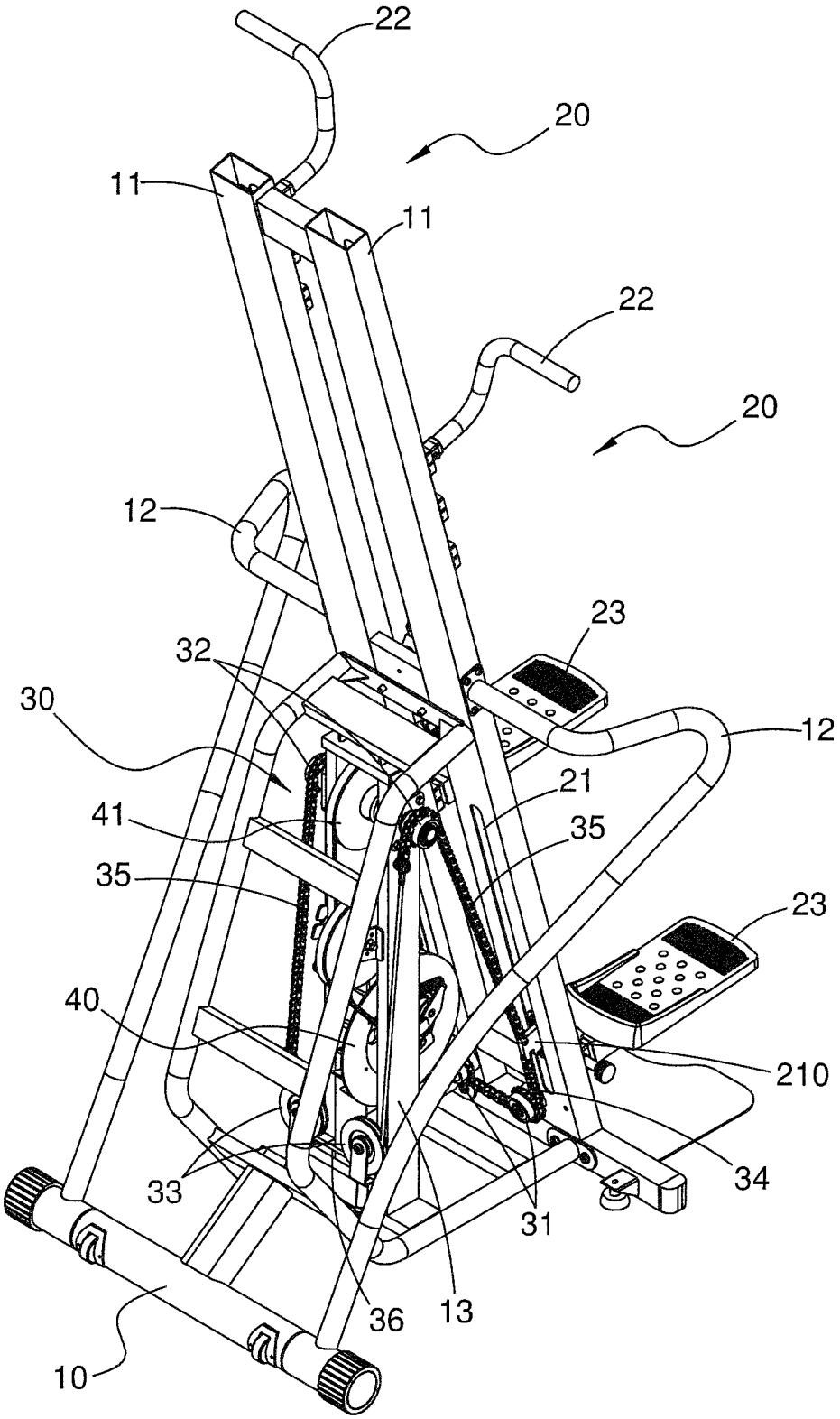
FIG. 3 is yet another rear perspective view to show the climbing exerciser of the present invention.
Figure 4:
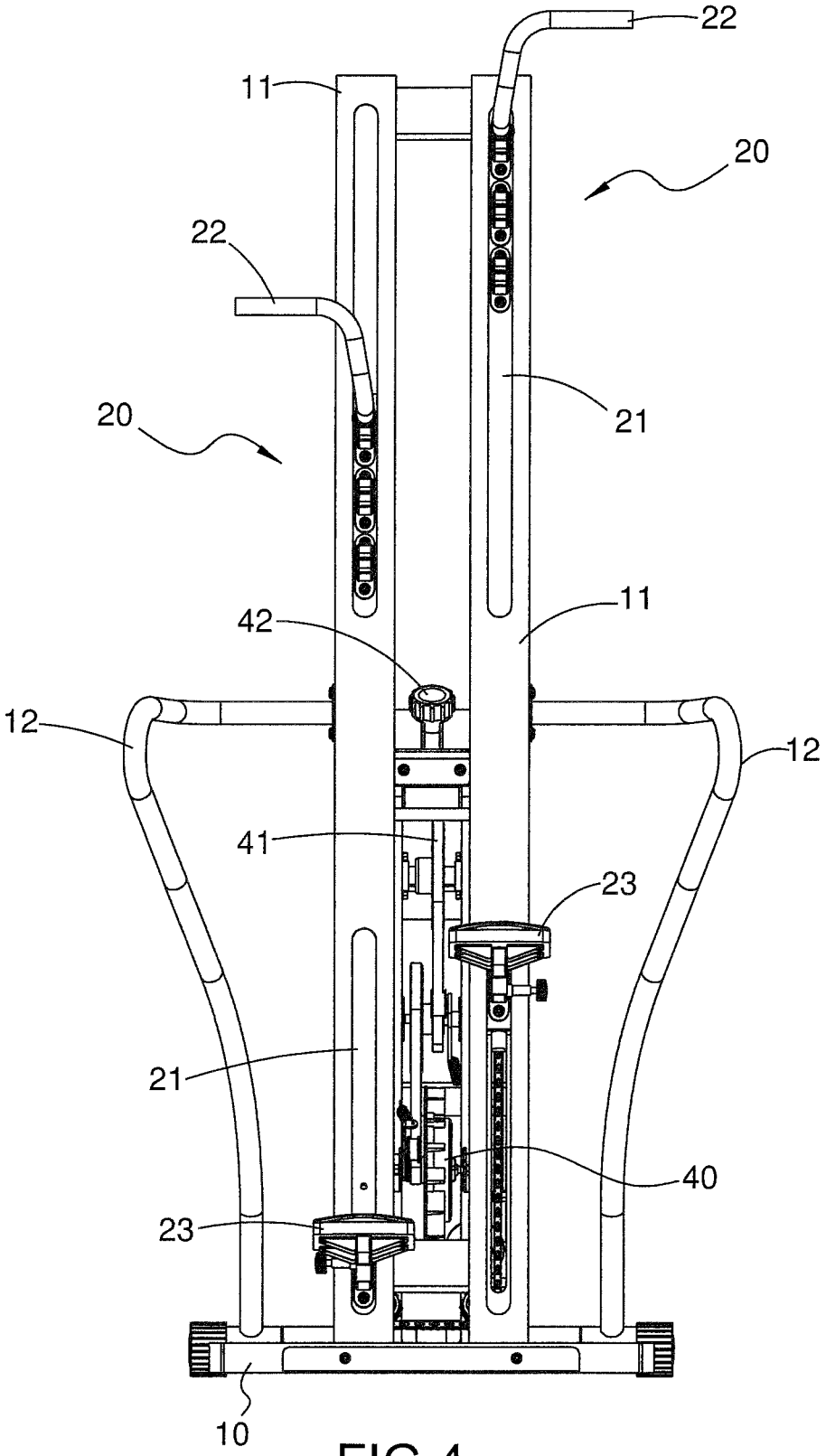
FIG. 4 is a front view of the climbing exerciser of the present invention.
Figure 5:
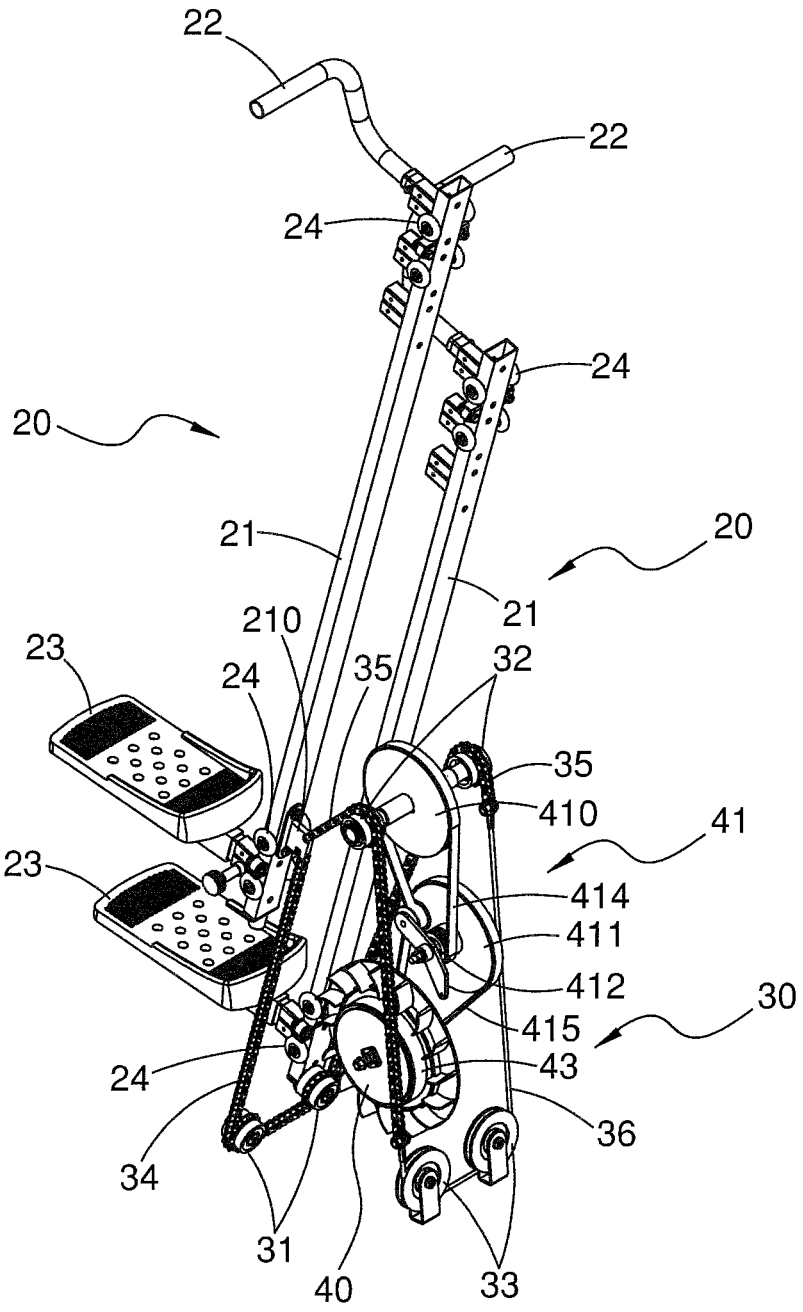
FIG. 5 is a perspective view to show the climbing exerciser of the present invention, wherein the base is removed.
Figure 6:
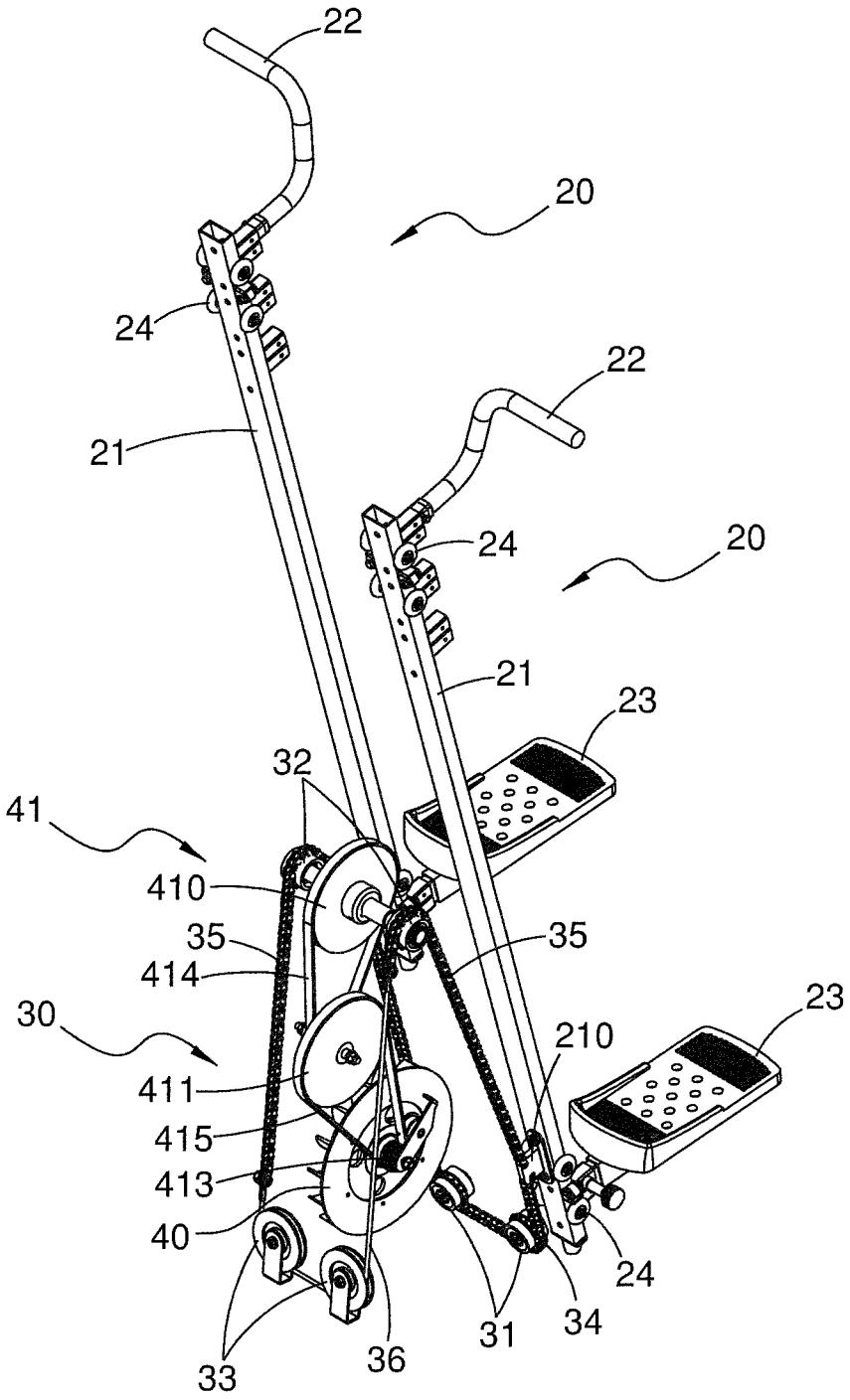
FIG. 6 is another perspective view to show the climbing exerciser of the present invention without the base.

Referring to FIGS. 1 to 6, the climbing exerciser of the present invention comprises a base 10 having two parallel rail posts 11 which are connected to the base 10 at an angle. A support 13 is connected to the rear side of the rail posts 11. Two hand rails 12 are located on two sides of the two rail posts 11 so that the users can hold the hand rails 12. Two sliding units 20 are respectively connected to the two rail posts 11, and each sliding unit 20 comprises a sliding rod 21, a handle 22 and a pedal 23. Multiple rollers 24 are respectively located on two sides of the two sliding rods 21 so that the sliding rods 21 smoothly move in the rail posts 11. The sliding rod 21 is movably located in the rail post 11 corresponding thereto, and a connection member 210 extends from the rea side of each sliding rod 21. The handle 22 has one end thereof detachably connected to the upper portion of the sliding rod 21 corresponding thereto. The pedal 23 has one end thereof detachably connected to the lower portion of the sliding rod 21 corresponding thereto.

A transmission unit 30 comprises two down chain wheels 31, two up chain wheels 32, two stationary pulleys 33, a front chain 34, two side chains 35 and a cable 36. The down chain wheels 31 are respectively and rotatably connected to the lower end of the rear side of the two rail posts 11. The two up chain wheels 32 are respectively and rotatably connected to the upper end of two sides of the support 13. The two stationary pulleys 33 are respectively and rotatably connected to the lower end of the rear side of the support 13. The two front chains 34 are engaged with two respective lower portions of the down chain wheels 31 and connected with the two respective connection members 210 of the two sliding rods 21. The two side chains 35 are engaged with two respective upper portions of the two up chain wheels 32 and connected with the two respective connection members 210 of the two sliding rods 21. The cable 36 is engaged with two respective lower portions of the two stationary pulleys 33 and connected to the two side chains 35. Therefore, when one of the sliding rods 11 moves upward, the other one of the two sliding rods 11 moves downward. The movements of the two sliding rods 11 simulate actions of rock climbing to the users.

A magnetic-resistance unit 40 is connected to the support 13 and driven by a wheel unit 41 which is co-axially connected with the two up chain wheels 32. The resistance of the magnetic-resistance unit 40 is controlled by a control button 42 which is located at the front side of the base 10, and between the two rail posts 11 for convenience of operation.

Specifically, the magnetic-resistance unit 40 comprises a magnetically controlled wheel 43, a first wheel 410, a second wheel 411, a first sub-wheel 412, a second sub-wheel 413, a first belt 414 and a second belt 415. The first wheel 410 is co-axially connected with the two side chains 35. The second wheel 411 is co-axially connected to the first sub-wheel 412. The second sub-wheel 413 is co-axially connected to the magnetically controlled wheel 43. The first belt 414 is trained between the first wheel 410 and the first sub-wheel 412. The second belt 415 is trained between the second wheel 411 and the second sub-wheel 413. The wheel unit 41 includes multiple idle wheels to adjust tension of the first and second belts 414, 415.

Figure 7:
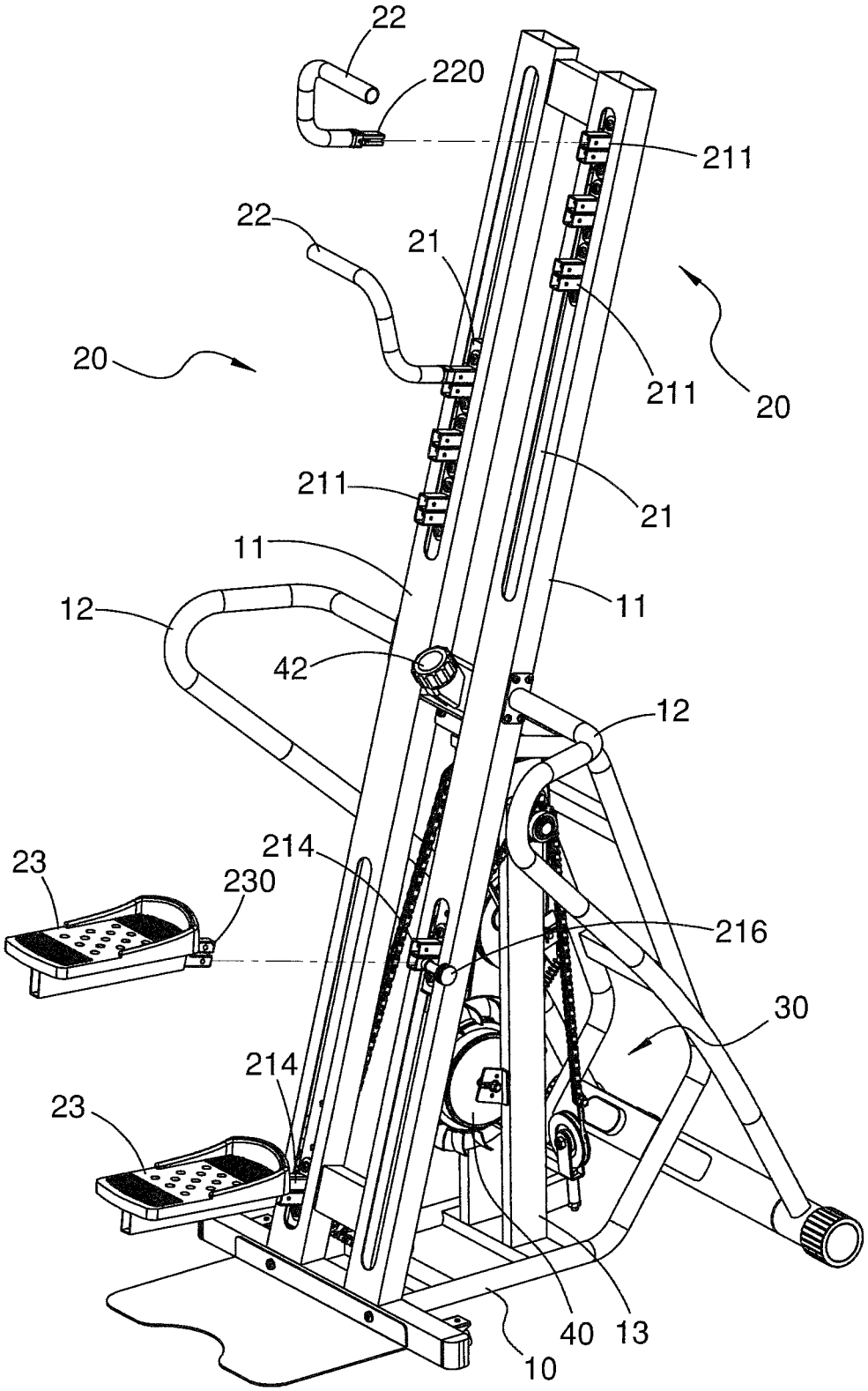
FIG. 7 shows an exploded view to show one handle, one pedal, and the climbing exerciser of the present invention.
Figure 8:
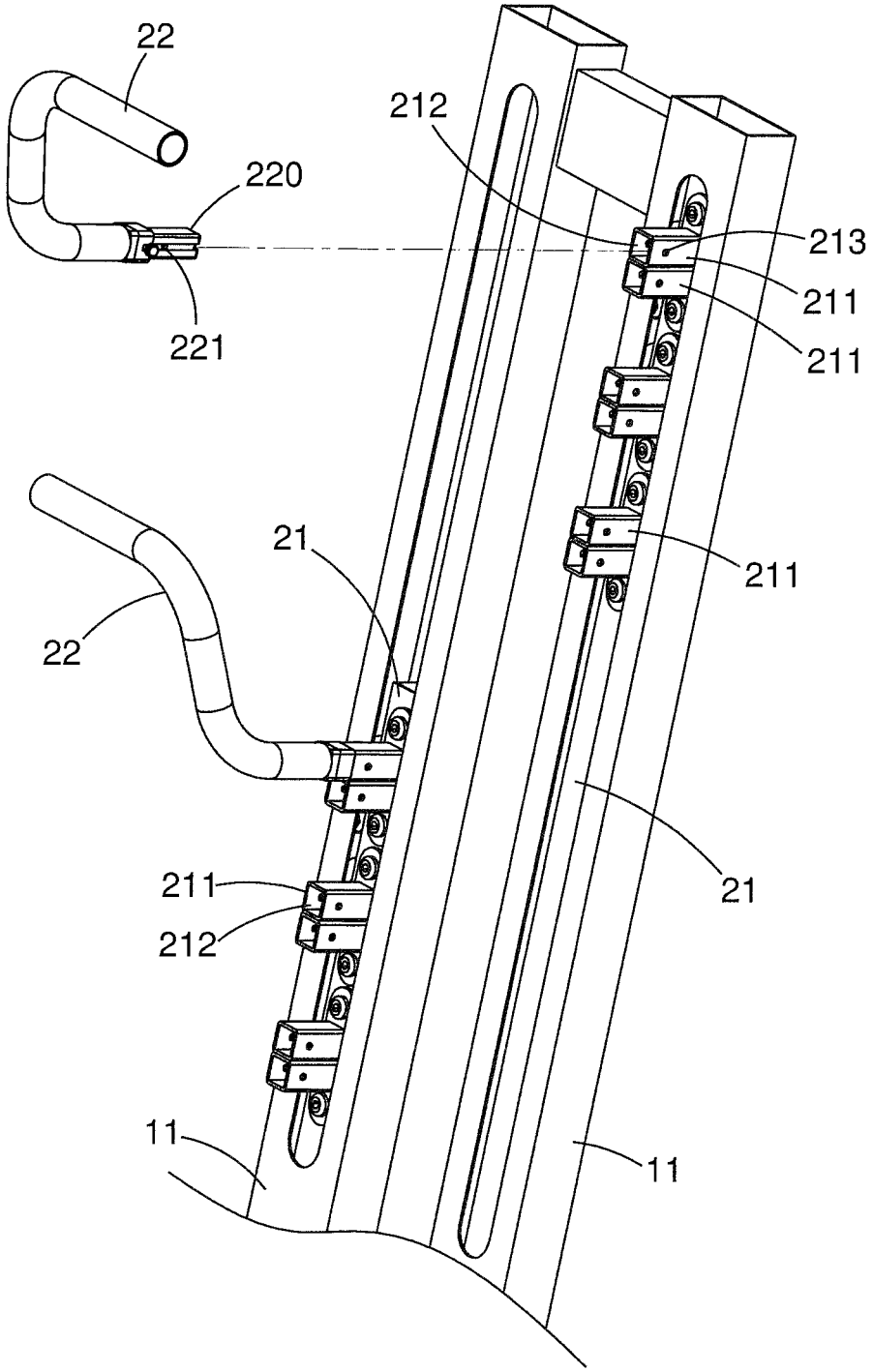
FIG. 8 is an enlarged view to show the handle and the seat on the sliding rod.
Figure 9:
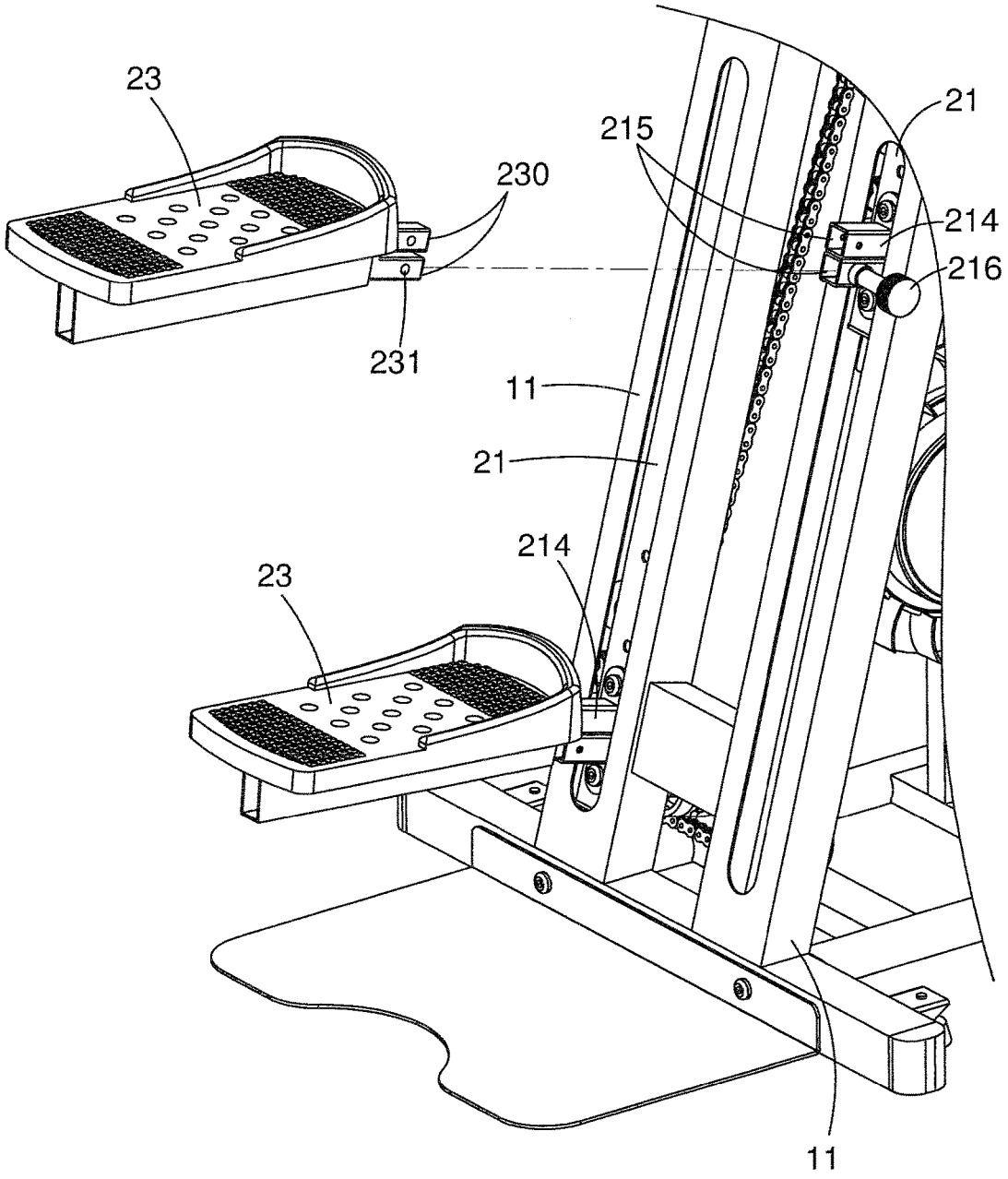
FIG. 9 is an enlarged view to show the pedal and the seat on the sliding rod.

As shown in FIGS. 7 to 9, each of the sliding rods 21 has multiple seats 211 connected to the front side of the upper portion thereof. Each seat 211 has a first recess 212, and a positioning hole 213 is defined laterally through the seat 211. Each handle 22 has an insertion 220 which is inserted into the first recess 212 of one of the seats 211. Each insertion 220 has a resilient latch 221 which is detachably engaged with the positioning hole 213 of the seat 211 corresponding thereto. Each sliding rod 21 has positioning member 214 on the front side of the lower portion thereof. The positioning member 214 includes two second recesses 215 located in the axial direction of the sliding rod 21. A resilient pin 216 is inserted into one of the two second recesses 215 of each positioning member 214. Each pedal 23 includes two lugs 230 which are inserted into the two second recesses 215, and one of the two lugs 230 has an aperture 231 in which the resilient pin 216 is detachably inserted. Therefore, the handles 22 and the pedals 23 can be adjusted according the users' needs.

The two sliding rods 21 movably connected to the two rail posts 11 each are connected with a handle 22 and a pedal 23. The two sliding rods 21 are respectively connected with the two front chains 34 which are engaged with two respective lower portions of the two down chain wheels 31. The two side chains 35 are connected to the two sliding rods 21 and engaged with two respective upper portions of the two up chain wheels 32. The cable 36 is engaged with the two respectively lower portions of the stationary pulleys 33 and two ends of the cable 36 are connected between the two side chains 35. The user holds the two handles 22 and steps on the two pedals 23, when one of the sliding rods 21 moves upward, the other one of the two sliding rods 21 moves downward. The movements of the two sliding rods 21 simulate actions of rock climbing to the users.

While we have shown and described the embodiment in accordance with the present invention, it should be clear to those skilled in the art that further embodiments may be made without departing from the scope of the present invention.

What is claimed is:

1. A climbing exerciser comprising:

a base having two parallel rail posts which are connected to the base at an angle, a support connected to a rear side of the rail posts;

two sliding units respectively connected to the two rail posts, each sliding unit comprising a sliding rod, a handle and a pedal, the sliding rod being movably located in the rail post corresponding thereto, a connection member extending from a rear side of each sliding rod, the handle connected to an upper portion of the sliding rod corresponding thereto, the pedal connected to a lower portion of the sliding rod corresponding thereto;

a transmission unit comprising two down chain wheels, two up chain wheels, two stationary pulleys, a front chain, two side chains and a cable, the down chain wheels respectively and rotatably connected to a lower end of the rear side of the two rail posts, the two up chain wheels respectively and rotatably connected to an upper end of two sides of the support, the two stationary pulleys respectively and rotatably connected to a lower end of a rear side of the support, the two front chains engaged with two respective lower portions of the down chain wheels and being connected with the two respective connection members of the two sliding rods, the two side chains engaged with two respective upper portions of the two up chain wheels and being connected with the two respective connection members of the two sliding rods, the cable engaged with two respective lower portions of the two stationary pulleys and being connected to the two side chains, and a magnetic-resistance unit connected to the support and being driven by a wheel unit which is co-axially connected with the two up chain wheels, a resistance of the magnetic-resistance unit being controlled by a control button which is located at a front side of the base.

2. The climbing exerciser as claimed in claim 1, wherein the base comprises two hand rails located on two sides of the two rail posts.

3. The climbing exerciser as claimed in claim 1, wherein each of the handles has one end thereof detachably connected to an upper portion of the sliding rod corresponding thereto, each of the pedals has one end thereof detachably connected to a lower portion of the sliding rod corresponding thereto.

4. The climbing exerciser as claimed in claim 3, wherein each of the sliding rods has multiple seats connected to a front side of the upper portion thereof, each seat has a first recess, and a positioning hole defined laterally through the seat, each handle has an insertion which is inserted into the first recess of one of the seats, each insertion has a resilient latch which is detachably engaged with the positioning hole of the seat corresponding thereto.

5. The climbing exerciser as claimed in claim 3, wherein each sliding rod has positioning member on a front side of a lower portion thereof, the positioning member includes two second recesses located in a axial direction of the sliding rod, a resilient pin is inserted into one of the two second recesses of each positioning member, each pedal includes two lugs which are inserted into the two second recesses, one of the two lugs has an aperture in which the resilient pin is detachably inserted.

6. The climbing exerciser as claimed in claim 1, wherein the magnetic-resistance unit comprises a first wheel, a second wheel, a first sub-wheel, a second sub-wheel, a first belt and a second belt, the first wheel is co-axially connected with the two side chains, the second wheel is co-axially connected to the first sub-wheel, the second sub-wheel is co-axially connected to the magnetically controlled wheel, the first belt is trained between the first wheel and the first sub-wheel, the second belt is trained between the second wheel and the second sub-wheel.

7. The climbing exerciser as claimed in claim 6, wherein the wheel unit includes multiple idle wheels to adjust tension of the first and second belts.

8. The climbing exerciser as claimed in claim 1, wherein multiple rollers are respectively located on two sides of the two sliding rods so that the sliding rods smoothly move in the rail posts.

* * * * *